US006158360A

United States Patent [19]

Cheng

[11] Patent Number: 6,158,360

[45] Date of Patent: Dec. 12, 2000

[54] MULTI-LEVEL ROTATIONAL SHELF STRUCTURE

[76] Inventor: Kuei-Ching Cheng, No. 7, 217 Lane, Chen-Dong Road, Ho-Mei Chen, Chang-Hua Hsien, Taiwan

[21] Appl. No.: 09/357,960

[22] Filed: Jul. 21, 1999

[51] Int. Cl.[7] ..... A47F 05/08

[52] U.S. Cl. ..... 108/103; 108/42; 108/139; 248/240; 211/90.01; 211/96

[58] Field of Search ..... 108/42, 27, 94, 108/103, 139, 148, 152, 183, 184; 211/88.01, 90.01, 95, 96, 90.04, 90.03, 106, 144, 150; 248/240, 240.4, 289.11

[56] References Cited

U.S. PATENT DOCUMENTS

| | | | |
|---|---|---|---|
| 496,173 | 4/1893 | Smith | 211/96 X |
| 531,257 | 12/1894 | Bond | 108/103 X |
| 586,977 | 7/1897 | Sibley | 211/96 X |
| 926,659 | 6/1909 | Laroussini | 211/96 X |
| 3,543,699 | 12/1970 | Leikarts | 108/103 X |
| 5,038,945 | 8/1991 | Melkonian | 211/96 |

FOREIGN PATENT DOCUMENTS

| | | | |
|---|---|---|---|
| 2256629 | 7/1975 | France | 108/103 X |
| 441219 | 7/1975 | Germany | 211/95 X |

*Primary Examiner*—Janet M. Wilkens
*Assistant Examiner*—Michael J. Fisher
*Attorney, Agent, or Firm*—Dougherty & Troxell

[57] ABSTRACT

A multi-level rotational shelf structure including top and bottom suspension tubes fastened to the surface of a wall with a plurality of shelves between the suspension tubes. Each shelf is supported on a bushing assembly which enables each shelf to pivot about an axis between the top and bottom suspension tubes independently of the other shelves. An upright tube extends between adjacent shelves acting as a spacer and a mount for the bushing assemblies.

1 Claim, 4 Drawing Sheets

MULTI-LEVEL ROTATIONAL SHELF STRUCTURE

BACKGROUND OF THE INVENTION (a) Field of the Invention

This invention relates to a type of multi-level rotational shelf structure. This shelf has a pivot joint on one end, which is fitted onto a lock end component. Additionally, each end of the pivot joint has washers that clasp a bushing end. Furthermore, the other end of the two bushings separates a suspension tube or an upright tube's pivot connection. Moreover, the pivot joint can rotate on the bushing. This invention can be fitted with a plurality of upright tubes and shelves, forming a multi-level rotational shelf structure.

(b) Description of the Prior Art

Conventional shelves typically have only one shape, which is continually repeated as a shelf space shelf structure. The said single shelf structure is unable to satisfy the needs of the user when there is a need to frequently change its angles in order to place objects upon it. If an odd shaped object is set next to the shelf, the entire shelf must be moved to one side. There is no way to move just one single shelf, which in turn creates a waste of valuable space. At best, due to the same problem, the shelf will be moved into a tilting position, detracting from the room's beauty.

SUMMARY OF THE INVENTION

In view of the conventional products' foregoing practical drawbacks, the inventor actively researched and designed. During this time, numerous tests and modifications were made until finally the successful development was brought forth, completely eliminating all the foregoing shortcomings of the conventional products. It is a great improvement in practical efficiency for the invented Multi-level Rotational Shelf Structure.

The invention's primary purpose is to present a type of multi-level rotational shelf structure. After the shelf's pivot joint passes through the lock end component, bushings are slipped into each end of the pivot joint, thus separating the suspension tube and the upright tube pivot connection. This allows the pivot joint to turn on the bushings. Additionally, this invention can meet the users needs by being able to add a plurality of shelves and upright tubes, thus realizing the purpose of the multi-level rotational shelf structure.

Another purpose to this invention is to offer an easy to assemble multi-level rotational shelf structure. The bushing at one end of the lock end component is directly fixed onto the threaded rod, while the other end is slipped into the threaded rod. Next, a nut is screwed onto the threaded rod's protruding end, securely tightening the said bushing. This allows the bushings in the two ends of the lock end component to be inserted into the suspension tube and the upright tube. Since the nut can be tightened with a pneumatic tool, it's not only easy to assemble but saves time over manual methods of assembly.

The other purpose to this invention is to offer a space saving multi-level rotational shelf structure. When the user turns the shelf, this shelf will drive the bushing within the pivot joint to turn as well. However, the said suspension tube, screwed to the wall's surface and the upright tube, on top of threaded rod's bolted lock end component will not turn. Additionally, a single shelf can be adjusted by turning. This not only saves indoor space, but also allows for tidy placement, maintaining the indoor beauty. This invention can accommodate a user's needs by adding a plurality of shelves with an equal number of upright tubes. This realizes a segmented angled adjustable multi-level rotational shelf structure that doesn't waste valuable space.

BRIEF DESCRIPTION OF THE DRAWINGS

In order to gain a better perspective of the invention, the following diagrams and their descriptions are provided. It is believed these diagrams will clearly describe the invention's purposes, functions and technical methods, whereby.

DESCRIPTION OF THE PREFERRED EMBODIMENT

Figure 1:
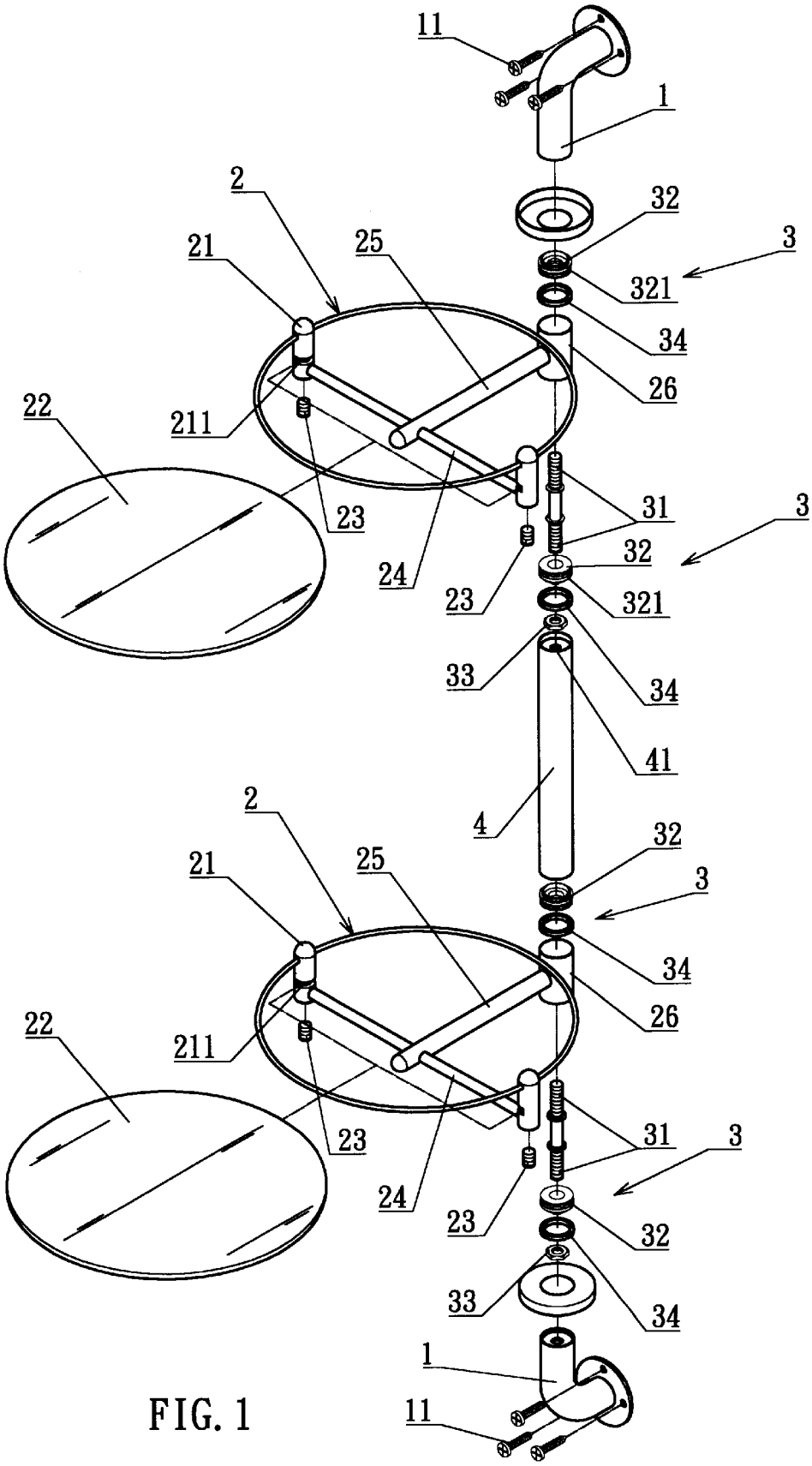
FIG. 1 is a sectional diagram of the invention.
Figure 2:
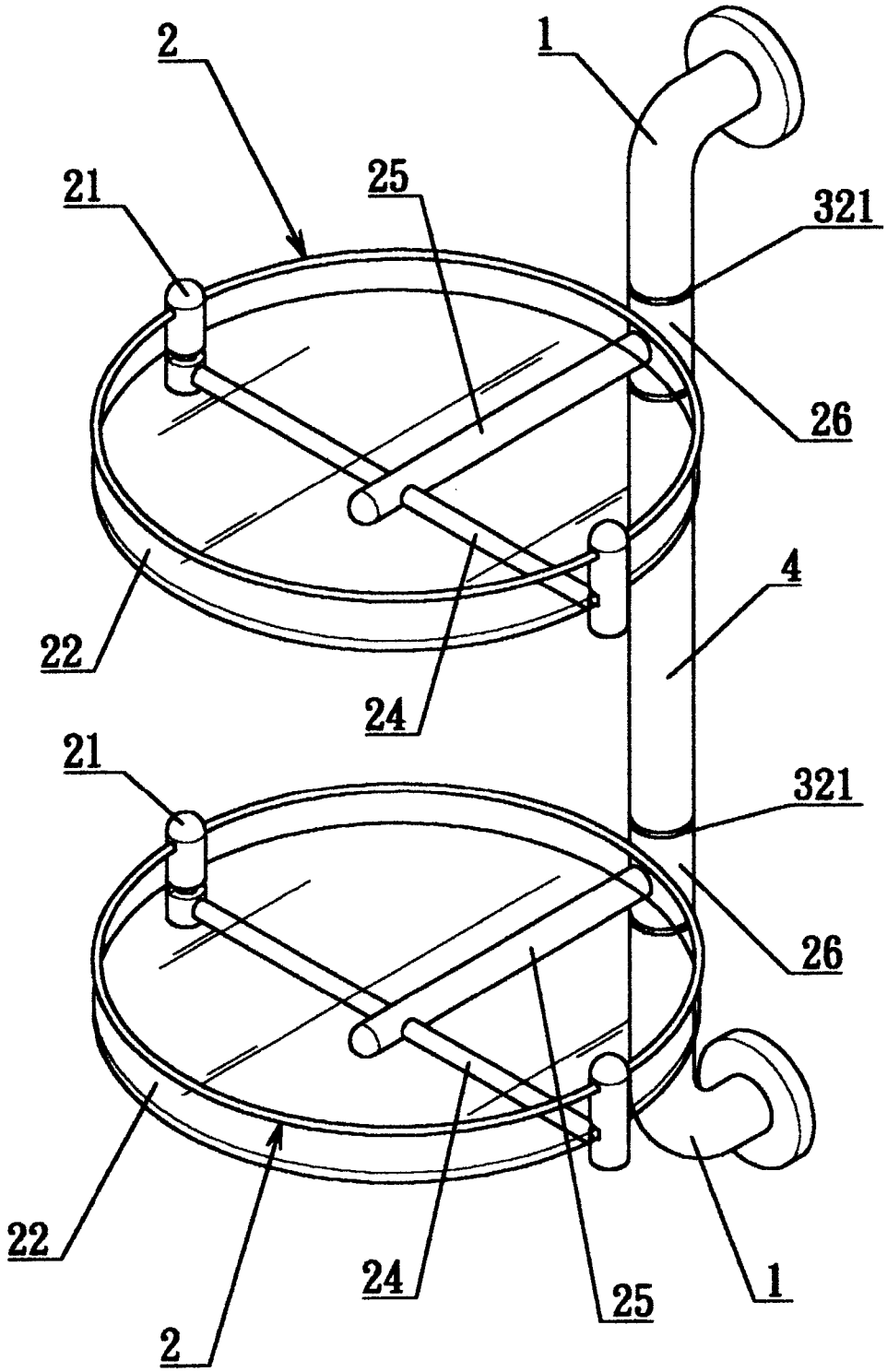
FIG. 2 is a diagram of the invention assembled.

For a better understanding of this invention's structural form, please refer to FIGS. 1 and 2. This invention mainly consists of two suspension tubes 1, that are secured to the surface of a wall by the screws 11 and between these two suspension tubes 1 are a plurality of shelves 2. The assembly is completed with the bushings 32 clasping on the shelf's lock end component 3 as well as on each end of the inner threads 41, and is then fixed onto the upright tube 4 of the lock end component 3.

On each side of the said shelf 2 is a fastening piece 21. Also, at the center of the fastening piece 21 is a perfectly fitting horizontal disk 22, which is clasped by the recess 211. After the bolt 23 is screwed onto the bottom of fastening piece 21, the horizontal disk is 22 is pressed tightly in the recess 211 of the fastening piece 21. Additionally, on each side, at the bottom of the shelf 2 is a support bar 24 of the horizontal disk 23, which acts as a support. Furthermore, extending from the support bar 24 is a brace 25. The other end of the brace 25 is fitted and secured to the lock end component 3, and whose end is the pivot joint 26.

The lock end component 3 passes through threaded rod 31 of the pivot joint 26 and is sectioned with washers 34, which in turn clasp onto the bushings 32 of the pivot joint 26. On one end, a bushing 32 of the lock end component 3, is passed into the pivot joint 26 and is screwed directly to the threaded rod 31. At the other end, a bushing 32 is placed onto the threaded rod 31, then the protruding end of the threaded rod 31 is screwed onto the nut 33, securing the position for the said bushing 32. Furthermore, the two ends of the bushings 32 for lock end component 3 clasp the washers 34 on the pivot joint 26 while the other end of both bushings 32 forms onto the suspension tube 1 and the upright tube 4. The said bushings 32 are bodies of plural surfaces, whereby in the middle section, a circular flange 321 structure protrudes. This allows both ends of the bushings 32 to be slipped into the pivot joint 26, as well as either the suspension tube 1 or the upright tube 4. The flange circumference equals that of the bushings 32. Once these are assembled, they form a smooth sliding tubular structure.

Figure 3:
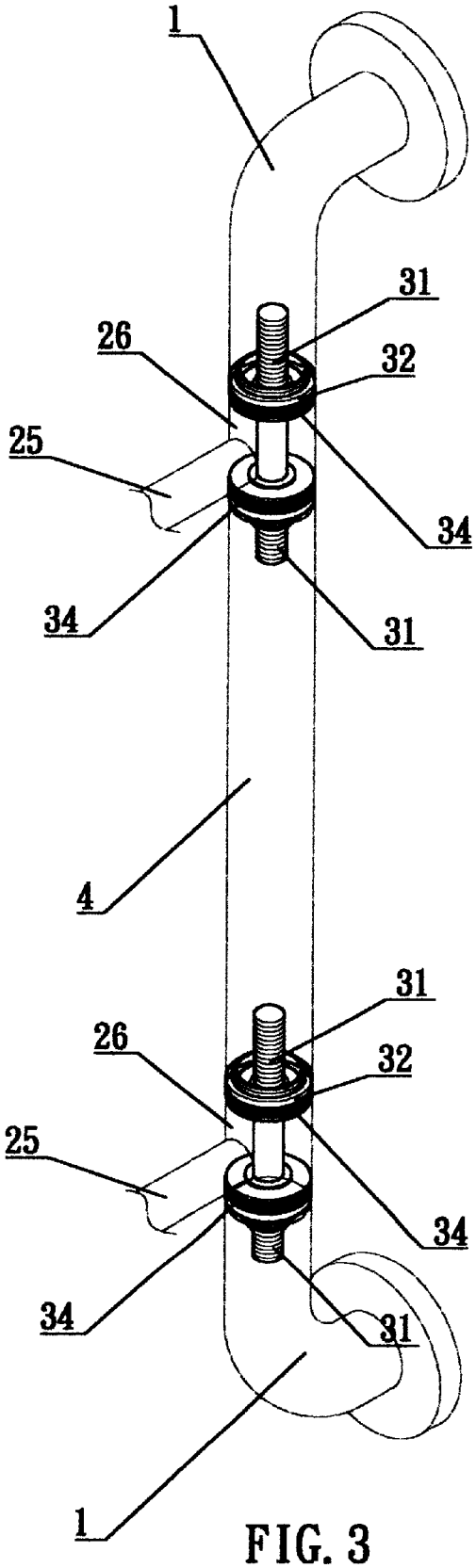
FIG. 3 is an assembly perspective view of the invention.

Please refer to FIG. 3, which is another perspective view of the invention. After the said shelf's 2 pivot joint 26 passes through the lock end component 3, at each end of the pivot joint 26, washers 34 clasp bushings 32. Furthermore, after the other end of the bushings 32 is separated by the suspension tube 1 and the upright tube 4, the nuts 33 are screwed onto one end of the threaded rod 31 of the lock end component 3. This ensures that the bushings 32, which are slipped onto the threaded rod 31, won't come off threaded rod 31.

Figure 4:
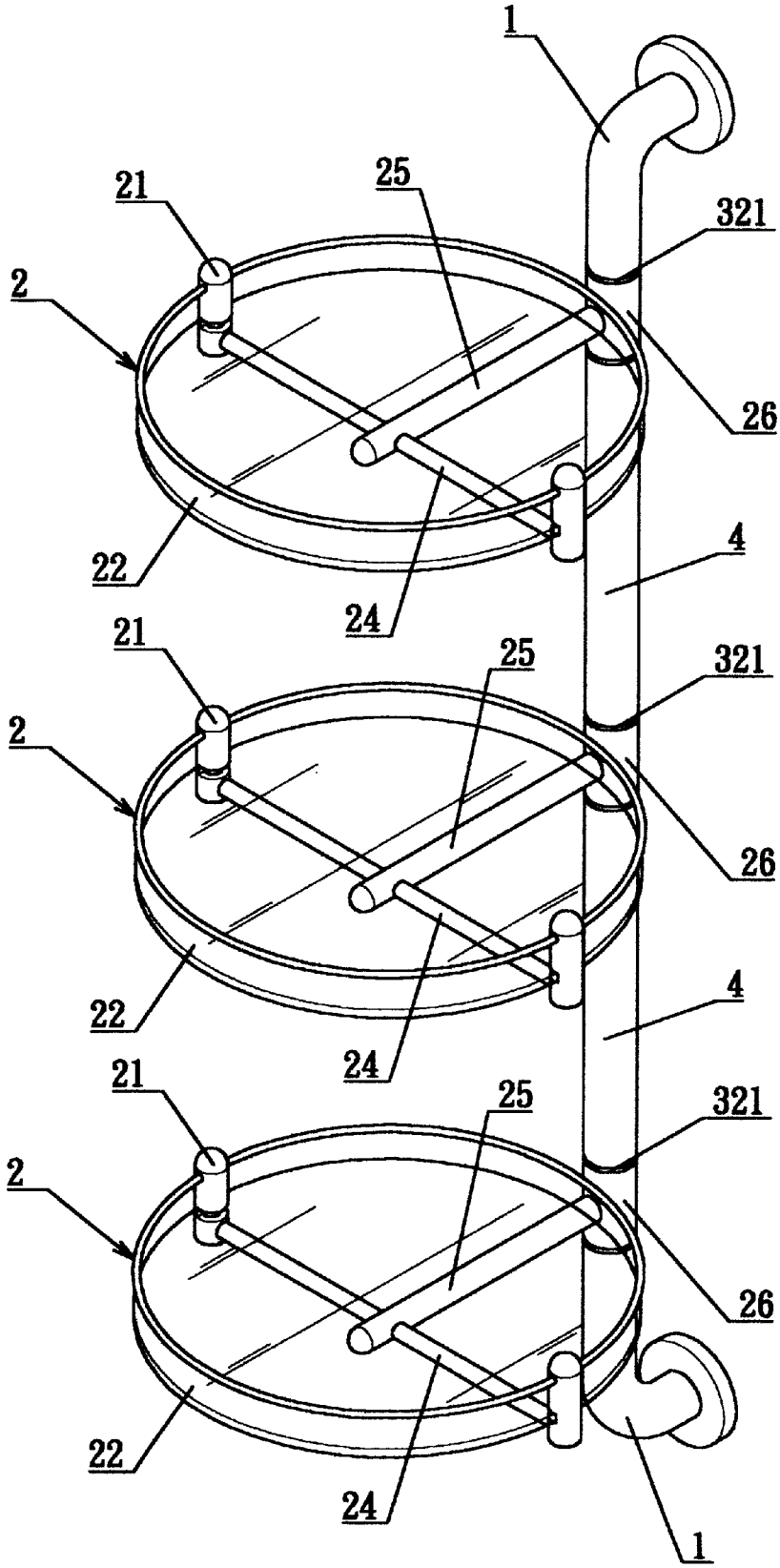
FIG. 4 is another perspective view of the invention.

As the user turns the shelf 2, the shelf 2 itself drives the pivot joint 26 within bushing 32 to turn as well. In this way, a single shelf 2 may be adjusted to another angle, in order to accommodate odd shaped objects, which are placed next to the multi-level shelf. It not only utilizes previously unused space, but also permits tidy arrangement, which will not spoil a room's beauty. Neither the suspension tube 1, which is screwed securely to a wall's surface, nor the upright tube 4, which is screwed into the threaded rod 31 of the lock end component 3, can turn. Thus, the shelf 2 turns smoothly within the bushings 32 with the assistance of the washers 34. Additionally, there is no stiff friction with the bushings 32. Moreover, this invention can meet the needs of the user by adding a plurality of shelves 2 and upright tubes 4. Please refer to the indication in FIG. 4, which is another perspective view. This invention can accomodate a user's needs by adding a plurality of shelves with an equal number of upright tubes. This realizes a segmented angled adjustable multi-level rotational shelf structure that doesn't waste valuable space.

Summarizing the above, it can be seen that the multi-level rotational shelf structure of the present invention is, by means of the features of its special structure, really capable of achieving the various objectives as claimed in the invention. In addition, tremendous practical effects are also immensely increased in the conventional products. Therefore, it is apparent that the present invention has fully met the prerequisite requirement of a new patent. Accordingly, a patent application is hereby filed pursuant to applicable law with your office, and your kind approval would be highly appreciated.

What is claimed is:

1. A multi-level rotational shelf structure configured to be fastened to a wall surface, and comprising two suspension tubes with a plurality of shelf assemblies fitted between the two suspension tubes, each shelf assembly having a shelf and a lock end component with bushings which fit onto and clasp the shelf, and an upright tube fastened onto the lock end component between adjacent shelves, wherein:

a) each shelf engages a recess in a fastening piece and is clamped by a bolt threaded into the fastening piece, at a bottom of the shelf, the fastening piece is connected to a support bar located at the bottom of the shelf, and extending from the support bar is a brace having an end securely fitted with a pivot joint of the lock end component; and b) the lock end component includes a pivot joint threaded rod, including a washer that clasps onto the bushing, one side of the bushing is fixed on the lock end component passes through the pivot joint and is secured in position by a nut screwed onto the end of the threaded rod, an end of the bushing is inserted into one of the suspension tubes and the upright tube, whereby in a middle section, a circular flange structure protrudes allowing ends of the bushings to be slipped into the pivot joint, and wherein the flange circumference equals that of the bushings, so as to form a smooth pivoting tubular structure.

* * * * *